United States Patent [19]

Finzel

[11] Patent Number: 4,588,167

[45] Date of Patent: May 13, 1986

[54] PORTABLE POWER DRIVEN WINCH

[75] Inventor: Jack E. Finzel, Milwaukie, Oreg.

[73] Assignee: Portable Power Tools, Inc., Portland, Oreg.

[21] Appl. No.: 639,924

[22] Filed: Aug. 9, 1984

[51] Int. Cl.[4] ..... B66D 1/14; B66D 5/10

[52] U.S. Cl. ..... 254/346; 254/365; 254/378

[58] Field of Search ..... 254/346, 355, 356, 358, 254/365, 370, 378

[56] References Cited

U.S. PATENT DOCUMENTS

| | | | |
|---|---|---|---|
| 625,974 | 5/1899 | Hansen | 254/346 |
| 802,323 | 10/1905 | Roewe | 254/346 X |
| 2,417,199 | 3/1947 | Hite | 254/356 |
| 3,322,398 | 5/1967 | Smith | 254/346 |
| 4,145,028 | 3/1979 | Kelley et al. | 254/346 |
| 4,162,059 | 7/1979 | Fletchall | 254/365 |
| 4,444,375 | 4/1984 | Horn | 254/356 |

*Primary Examiner*—Stuart S. Levy
*Assistant Examiner*—Katherine Matecki
*Attorney, Agent, or Firm*—Chernoff, Vilhauser, McClung, Birdwell & Stenzel

[57] ABSTRACT

A small, light, portable winch having a small gasoline engine, a centrifugal clutch connecting the engine through reduction gears, sprockets, and a chain to a spool having a cable which can be wound on the spool. A positive clutch can be disengaged to permit cable to be withdrawn safely from the spool while the engine is running. A brake permits cable to be controllably unwound from the spool under load. A two-legged bridle attached to the spool-supporting frame and handles on the winch facilitate smoothly spooling cable on the drum. A lever connected to a throttle control cable is conveniently located within reach from one of the handles, while the brake is controlled by a lever conveniently within reach from the other of the handles, and is adjustable.

7 Claims, 6 Drawing Figures

PORTABLE POWER DRIVEN WINCH

BACKGROUND OF THE INVENTION

The present invention relates to power driven winches, and particularly to a light, portable winch driven by a small internal combustion engine.

It is well known to provide winches driven by electric motors powered by the electrical system of motor vehicles, and to have such winches equipped with mechanical devices for ensuring that cable is wound smoothly on the spool of such a winch. Such previously-known winches, however, haVe not been particularly useful in situations such as handling of small logs and similar objects which might be encountered by people cutting firewood in areas not easily reached by motor vehicles, and in moving objects which are not easily moved by hand but are not so heavy as to require the use of large powered equipment. While some winches of the size of a small wheelbarrow have been previously available, even such a winch is unsuitably large for use in some remote locations.

Provision should be made in a winch, even a small portable winch, for ensuring that cable can be wound smoothly upon the spool of the winch, in order to avoid burying turns of wire within previously wrapped turns of wire on the winch spool, because such burying of cable within previously wound turns may result in damage to the cable which would weaken it, making it unsafe for future use.

A winch needs an easily operable brake to help hold a load at a desired height when the motor is not actually winding cable inward, and it should be possible to lower a load as well as raise it, for a powered winch to be most practical.

Recently, winches have been made available which are adapted for being driven by a chainsaw engine. Such adaptations, however, have lacked certain desirable features, such as the ability to control both inhauling operation and lowering of a load conveniently. Additionally, in situations where a small portable winch may be needed, as in hauling wood as it is being cut into firewood, it would be extremely inconvenient to have to use a chainsaw motor to drive such a winch, since that use would make the chainsaw unavailable. Furthermore, while some chainsaws are equipped with brakes to stop rotation of the saw chain when the throttle is released, such a brake is not particularly well adapted to holding a load suspended by a winch driven by the chainsaw engine. A chainsaw is designed, finally, to be balanced when equipped with the normal chainsaw bar and chain, and mounting of an adapted winch to be driven by such a chainsaw's engine does not result in a balanced, easily handled power-driven winch.

What is needed therefore, is an improved power-driven portable winch which is light, well balanced, and includes for the sake of safety, a brake which can be used for controllably allowing cable to be unwound, control devices for the brake and to control the speed of operation of the winch, and provision for smoothly winding cable upon the cable spool or drum in order to avoid damage to the cable and avoid difficulty in unwinding the cable.

SUMMARY OF THE INVENTION

The present invention overcomes some of the shortcomings of the prior art and provides a lightweight, powerful, and easily portable power driven winch which is safe and easy to operate. In accordance with the present invention a small, lightweight gasoline engine is attached on one side of a reduction gear housing, while a cable spool is mounted on a frame extending from the other side of the reduction gearcase. Within the reduction gear housing a centrifugal clutch controls application of the engine's power to drive the winch spool to wind cable upon the spool. A positively engaging clutch permits the reduction gear set to be disconnected from a sprocket drive shaft, allowing the cable spool to free-wheel so that cable may be unwound from it. An easily adjustable brake is provided to control rotation of the winch spool both while the positive clutch is engaged and while it is disengaged, so that the winch may be used to controllably lower a load with the engine running but the centrifugal clutch disengaged. A bridle consisting of a pair of equal arms joined to a single anchor line is attached to ears provided on opposite ends of the frame portion of the winch, so that the winch spool's axis of rotation normally remains perpendicular to the direction toward which the cable is extending. The operator can exert slight sidewards pressure to control the angle between the cable and the spool precisely to smoothly wrap the cable o the spool so that the cable will not bend excessively and be weakened by the cable as a result of uneven winding.

It is therefore a principal object of the present invention to provide a light, powerful cable winch which is easily portable.

It is another important object of the present invention to provide a portable cable winch which may be used both to raise and to lower loads.

It is yet a further object of the present invention to provide a portable power winch which is easy and safe to operate.

It is a principal feature of the present invention that it includes an adjustable lever-operated brake for controlling the rotation of the spool on which cable is wound.

It is another important feature of the present invention that it includes both a positive engagement clutch permitting the cable spool to be connected positively or disconnected from a reduction gear set, and a centrifugally operated clutch which connects the engine of the winch to the input side of the reduction gear set when the engine is operated at or above a predetermined speed.

It is a further feature of the present invention that it includes a bridle arrangement and a pair of handles attached to the reduction gear housing of the winch to enable an operator of the winch to control wrapping of the cable on the winch spool in such a way as to avoid damage to the cable.

It is a principal advantage of the present invention that it provides a winch which is smaller, lighter and yet as powerful and capable as previously available portable winches.

It is another advantage of the present invention that it provides a power-driven winch which is simpler to operate than previously available power-driven winches.

The foregoing and other objectives, features and advantages of the present invention will be more readily understood upon consideration of the following detailed description of the invention taken in conjunction with the accompanying drawings.

DETAILED DESCRIPTION OF THE DRAWINGS

Figure 1:
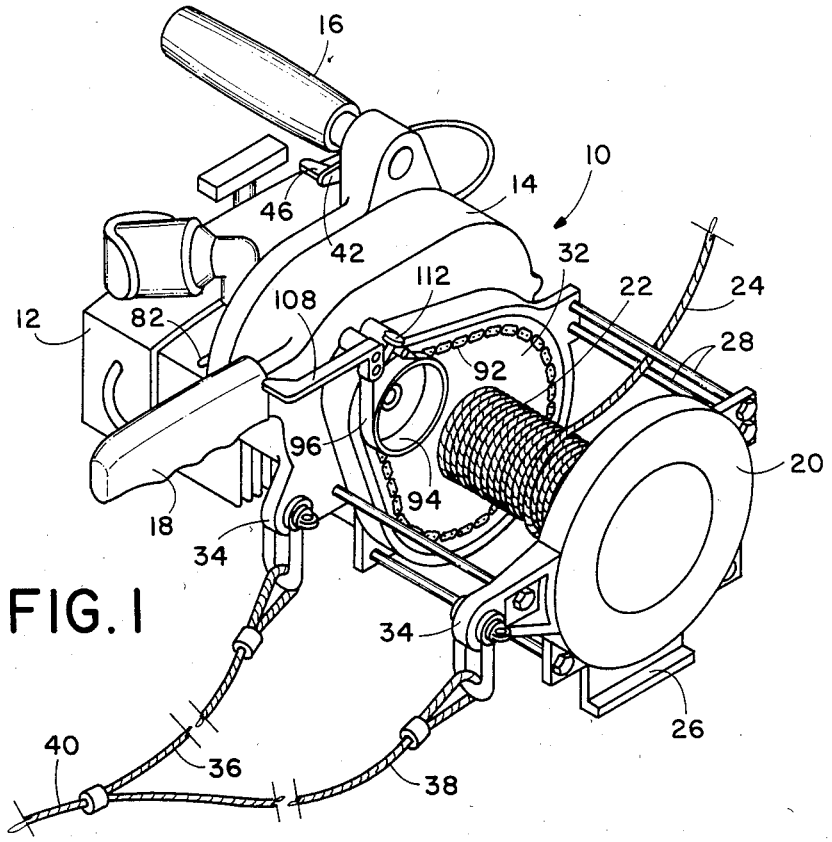
FIG. 1 is a perspective view of a portable winch embodying the present invention.

Referring now to the drawings in FIG. 1, an exemplary portable winch 10 is seen to include a small gasoline engine 12 attached to a reduction gear housing or case 14. Mounted on the reduction gear housing 14 are a pair of handles, an upper handle 16, which extends horizontally above the engine 12, and a rear handle 18, which extends horizontally rearward from the gearcase 14. Preferably, the engine 12 is a light-weight, two-cycle gasoline engine such as the Model TC200 or TC300 engines manufactured by the Tecumseh Products Co. of Grafton, Wis., which develop, respectively, 1.6 and 2.4 horsepower.

A frame 20 supports a cable spool 22 in appropriate bearings, and a cable 24 is wound upon the spool 22. The frame 20 includes a downwardly-extending foot 26 located at the righthand or outer end of the frame, and a similar foot 26 (FIG. 2) is provided on the reduction gear housing 44, to support the winch 10 on the ground in an upright attitude. In one embodiment of the winch 10, the entire winch is about 16 inches long, including the engine 12, gearcase 14 and frame 20, and weighs only 21 pounds.

Figure 6:
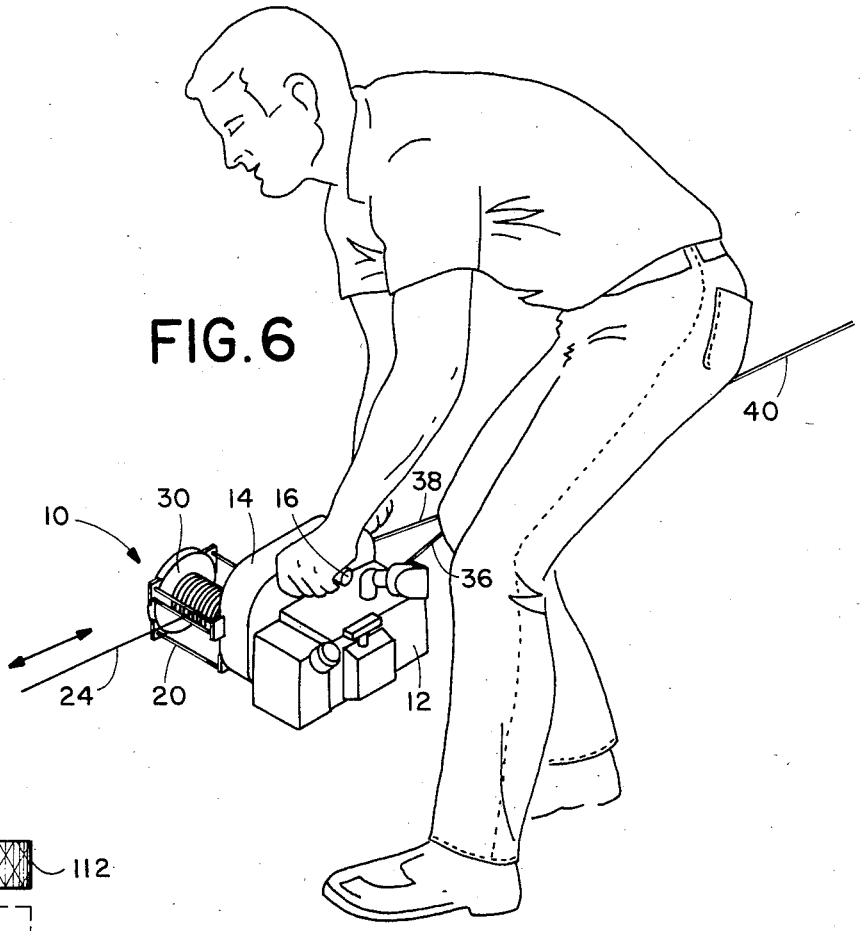
FIG. 6 is a perspective view from the left front, showing the portable winch of FIG. 1 in use.
Figure 5:
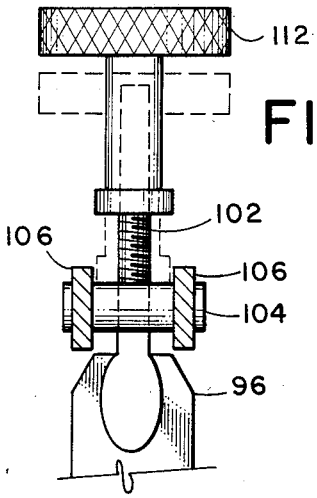
FIG. 5 is a sectional view of a portion of the brake mechanism shown in FIG. 4, taken along line 5—5.

The cable 24 extends generally perpendicularly away from the spool 22 in the direction in which tension is to be applied, passing between a pair of horizontal parallel guide bars 28 which are located one above the other. Ample room is provided between the guide bars 28 for the cable to pass between them without binding, yet there are close enough together to provide some straightening and guiding effect, with the space between the guide bars 28 being located at approximately the height at which the cable 24 is tangent to the top of the spool 22 or cable wound thereon. A flange 30 (FIG. 6) is located at the outer end of the spool 22, while a sprocket 32 which drives the spool, as will be explained presently, acts as a flange on the inner end of the spool 22, the end which is closer to the engine 12.

A pair of ears 34 extend rearwardly from the frame 20 at the height of the central axis of the spool 22, and a bridle having a pair of legs 36 and 38 is attached to the winch 10 by fastening the leg 36 to one of the ears 34 and the leg 38 to the other of the ears 34 by a shackle or other suitable fastener. The legs 36 and 38 are fastened together preferably by a swaged fastener and an anchor line 40 extends further, to be attached to a suitable anchor during operation of the winch 10.

Figure 2:
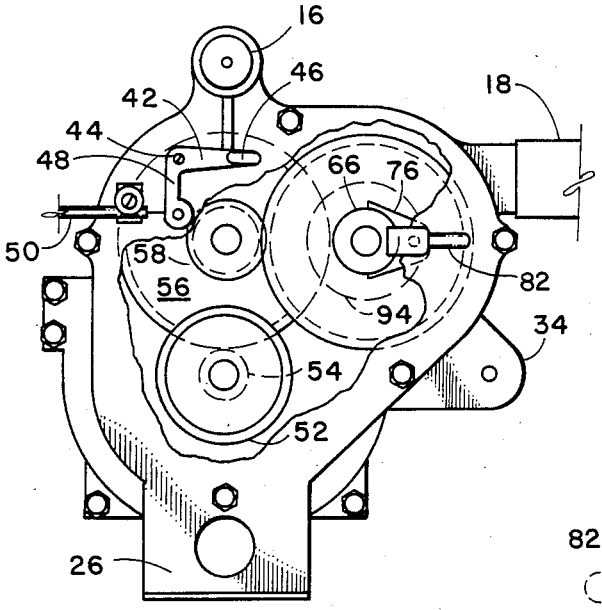
FIG. 2 is partially cut-away left end elevational view of the winch shown in FIG. 1, without its engine.

Referring now also to FIG. 2, a throttle control lever 42 is mounted pivotably on a pivot pin such as the screw 44 extending into the gearcase 14, parallel with the upper handle 16. A finger contact bar 46 extends parallel with the upper handle 16 and is located a slight distance, for example 1½ inches, below the upper handle 16, Where it may be grasped by the left index finger of a person operating the winch 10. A crank arm 48 extends downwardly from the screw 44, and the core of a flexible throttle control cable 50 is connected with the crank arm 48, so that raising the finger contact bar 46 toward the upper handle 16 pulls the core of the cable 50 and opens the throttle of the engine 12 to increase its operating speed. A spring (not shown) is associated with the cable 50 to urge the control lever 42 in a clockwise direction as seen in FIG. 2, thus ordinarily closing the throttle of the engine 12 to a predetermined minimum opening which preferably will allow the engine to run at idle speed. The location of the finger contact bar 46 below the upper handle 16 protects the throttle control lever and finger contact bar 46 from inadvertently being moved, as by contact with brush or branches while the winch 10 is being carried in wooded areas. Nevertheless, the finger contact bar 46 is conveniently within reach of the fingers of the operator's left hand so that the operator can easily control the speed of the engine 12 during operation of the winch 10.

Figure 3:
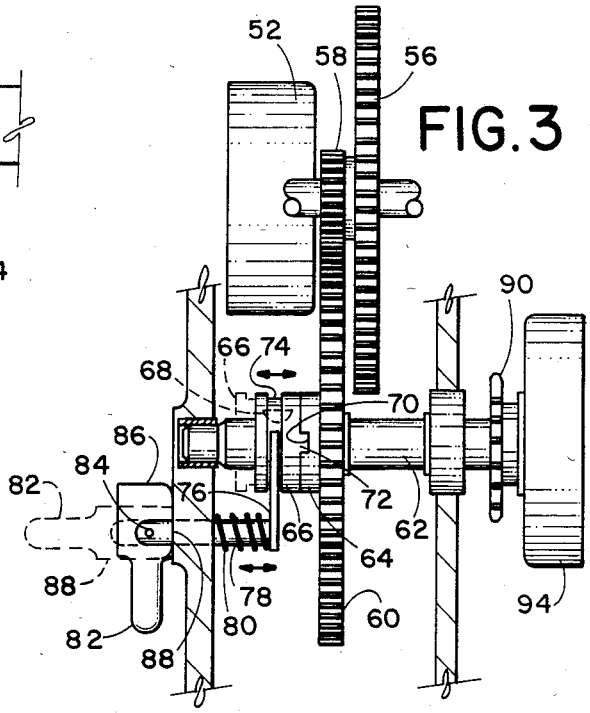
FIG. 3 is a top plan view of the reduction gear assemby and a portion of the gearcase of the winch shown in FIG. 1.

As may be seen in FIGS. 2 and 3, the engine 12 is connected through a centrifugal clutch having a clutch cup 52 located rotatably on a shaft mounted in the gearcase 14, with a drive pinion 54 attached to the output, or right, side of the clutch cup 52. The drive pinion 54 engages the larger gear 56 of a gear cluster whose smaller gear 58 is, in turn, meshed with a final driven gear 60 mounted rotatably on a final drive sprocket shaft 62. A stationary half 64 of a positive drive clutch is fixedly attached to the final driven gear 60, and a positive drive clutch sliding half 66 is slidably mounted on the drive sprocket shaft 62 so that it is slidable axially along the drive sprocket shaft 62. A key 68 is mounted in a slot in the shaft 62 and extends within a keyway within the clutch sliding half 66. A groove 70 is machined preferably diametrically across the stationary half 64 of the positive drive clutch, and corresponding dogs 72 are provided on a mating face of the sliding half 66.

An annular groove 74 is provided in the circumferential surface of the sliding half 66, and a slider fork 76 has a pair of arms matingly engaged in the annular groove 74 to control its position axially along the final drive sprocket shaft 60. The slider fork 76 is carried on an axially movable clutch operating rod 78 which extends parallel with the drive shaft 60 and to the outside of the gearcase 14 through an opening provided therefore in the gearcase 14. A helical spring 80 is disposed about the clutch operating rod 78, biasing it away from the engine 12 and thus by means of the slider fork 76 urging the sliding half 66 of the positive drive clutch along the final drive sprocket shaft 62, bringing the lugs 72 into engagement with the groove 70 of the stationary half 64 of the positive drive clutch, so that the sprocket shaft 62 will be driven by the final driven gear 60. A shift lever 82 is pivotably attached to an outer end of the clutch operating rod 78 by a pivot pin 84 which is located further from an inner end 86 of the shift lever 82 than from an inner side 88 of the shift lever 82. The inner end 86 and the inner side 88 both include generally planar surfaces which can lie flat against the outside of the gearcase 14. Thus, when the shift lever 82 is moved to extend outward and to be generally parallel with the clutch operating rod 78, the inner end 86 goes to lie flat against the outer surface of the gearcase 14, and the slider fork 76 is moved leftward by the clutch operating rod 78, sliding along the final drive sprocket shaft 62 and disengaging the dogs 72 from the groove 70 so that the sprocket shaft 62 may rotate freely within the hub of the final driven gear 60. When the lever 82 is turned so that the inner side 88 is adjacent the outside of the gearcase 14 the spring 80 urges the clutch operating rod 78 and fork 76 toward the fixed half 64, thus moving the sliding half 66 of the clutch and urging the lugs 72 toward the groove 70, so that the positive drive clutch will become engaged as soon as the clutch halves have rotated relative to one another to the proper position of alignment. In either position of the lever 82, the spring 80, acting on the clutch operating rod 78, holds the lever 82 against the outside of the gearcase 14, preventing accidental engagement or disengagement of the positive drive clutch.

Figure 4:
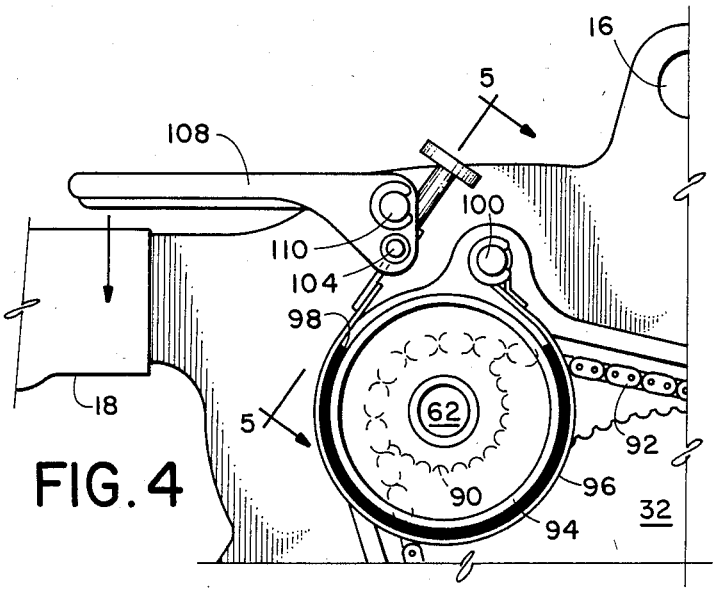
FIG. 4 is a detail view taken from the right end and showing the adjustable brake mechanism of the winch shown in FIG. 1.

Referring now to FIGS. 1-5, a sprocket 90 is mounted on the sprocket shaft 62. A roller chain 92 is fitted around the sprocket 90 and the sprocket 32 so that rotation of the sprocket shaft 62 drives the spool 22 and vice versa. A brake drum 94 is also fixedly mounted on the sprocket shaft 62. A strap 96 of metal, to which a brake lining 98 is bonded, is attached pivotably by one end to a brake anchor pin 100 extending from the gearcase 14. The other end of the strap 96 carries a threaded rod 102 attached fixedly thereto as by welding. The threaded rod 102 extends through a hole provided through a crosspin 104 carried pivotably in a pair of arms 106 of a brake application lever 108, which is pivotably mounted on a pivot pin 110 extending outward from the gearcase 14. A brake adjustment nut 112 includes a knurled knob at its upper end and is threadedly fastened on the threaded rod 102 to ride against the crosspin 104, so that downward movement of the brake application lever 108 applies tension on the brake strap 96, pressing the brake lining 98 against the outer surface of the brake drum 94. The brake application lever 108, as may be seen in FIGS. 1 and 4, is located conveniently adjacent to the rearwardly extending handle 18, where it may be operated conveniently by the thumb or a finger of the right hand of a person using the winch 10.

Preferably, the brake lining material is similar to the brake lining material manufactured by Scan-Pac, of Menomonee Falls, Wis., under the designation 230AF. This lining material is free from asbestos for the sake of safety in operating the brake. It is preferably bonded to the strap by an adhesive such as Plastiloc 605-4, a high-temperature brake lining adhesive available from the B. F. Goodrich Company of Akron, Ohio.

In operation, the anchorline 40, connected to the bridle including the legs 36 and 38, is attached to a fixed object, while an end of the cable 24 is attached by conventional means to an object which is to be moved using the winch 10. This is accomplished by first moving the shift lever 82 to the outwardly extending position disengaging the positive drive clutch dogs 72 from the groove 70, so that the spool 22 is free to rotate under the torque applied by pulling the cable 24. Pulling the cable 24 from the spool 22 thus does not involve any risk of accidental engagement of the centrifugal clutch which might cause injury by an unwanted tightening of the cable 24 while someone is manipulating it. Once the cable 24 has been attached to an object to be moved, the shift lever 82 is rotated to its position in which its inner side 88 is parallel with and in contact with the outer surface of the reduction gearcase 14, so that the spring 80 urges the slider fork 76 inward to engage the positive drive clutch dogs 72 in the groove 70 when they are aligned with one another upon first rotation of the sprocket shaft 62 relative to the final driven gear 60. With the engine 12 operating at idle speed, the finger contact bar 46 of the throttle control lever 42 is squeezed upwardly toward the upper handle 16, opening the throttle of the engine 12 and increasing its speed until the centrifugal clutch attached to the crank shaft of the engine 12 engages the centrifugal clutch cup 52. This in turn rotates the attached drive pinion 54 which is meshed with the larger gear 56, in turn driving the smaller gear 58 attached to the larger gear 56, so that the smaller gear 58 drives the final driven gear 60, rotating it until the dogs 72 engage the groove 70. The sliding half 66 then rotates the sprocket drive shaft 62, thereby driving the spool 22, winding the cable 24 upon the spool 22.

Ordinarily, the bridle legs 36 and 38 maintain the spool 22 oriented perpendicular to the line of pull of the anchor line 40, and ordinarily this results in the axis of rotation of the spool 22 also being approximately perpendicular to the cable 24, if the winch is supported by the handles 16 and 18 with tension in the cable 24 and the anchorline 40. By simply applying a slight amount of sidewards pressure, using the handles 16 and 18, the winch 10 can be moved sidewards to the appropriate position to cause the cable 24 to wrap itself neatly upon the spool 22, with each additional turn of cable lying neatly along side the previous turn on the spool 22 to form smooth layers of cable turns lying closely alongside on another along the entire length of the spool 22, so as to avoid subsequent turns of cable from burying themselves in previously wound layers of cable on the spool 22. It is important to avoid burying the cable, since such burying may result in damaging the cable, weakening or breaking individual strands of wire within the cable and thus making the cable more likely to break under application of intended loads.

Preferably, the combination of the power of the motor 12, the amount of reduction of speed of the shafts and accompanying amplification of torque are chosen so that the centrifugal clutch will slip before application of torque sufficient to break the cable 24 or the bridle, and before loading the engine 12 beyond its designed output torque. For example, the overall speed ratio between the engine 12 and the spool 20 may be 85⅓ to 1.

When handling a suspended load, the brake may be applied by pressing the brake application lever 108 downward with the thumb of the right hand to tighten the strap 96, thus forcing the brake lining 98 against the surface of the brake drum 94 to cause sufficient friction to resist the torque applied to the brake drum 94 by attempted rotation of the spool 22, transmitted through the chain 92 and sprocket 90. The brake can thus be used to suspend a load, or by manipulating the amount of pressure applied on the brake application lever 108 the brake may be used to controlably lower such a load, with the throttle control lever released to permit the engine 12 to run at idle speed, thus disengaging the centrifugal clutch to permit the spool 22 to rotate in a direction unwinding the cable 24.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A portable winch, comprising:

(a) a gearcase having opposite first and second ends, opposite front and rear sides, and a final driven shaft extending from said first end;

(b) a spool-supporting frame extending from said first end;

(c) a spool carried on said frame and defining a spool axis of rotation extending directly toward said gearcase;

(d) an engine fixedly attached to said second end of said gearcase;

(e) a first winch-supporting handle extending from said second end of said gearcase and located above said engine and forward of and generally parallel with said spool axis of rotation;

(f) a second winch-supporting handle extending generally perpendicular to and rearwardly from said rear side of said gearcase;

(g) a throttle control lever mounted on said second end of said gearcase and rotatable about a throttle control lever axis extending substantially parallel with said first handle;

(h) a finger contact bar attached fixedly to said throttle control lever, extending generally parallel with and located below said first handle and spaced apart therefrom, but within reach of a hand holding said first handle, and moveable toward said first handle so as to rotate said throttle control lever about said throttle control lever axis;

(i) means connecting said throttle control lever to said engine for accelerating said engine in response to movement of said finger contact bar toward said first handle;

(j) a brake drum mounted on said final driven shaft;

(k) a brake band encircling said brake drum; and (l) brake lever means pivotably mounted on said first end of said gearcase and extending rearwardly alongside said second handle, within reach of a finger of a hand while said hand holds said second handle, for selectively tightening said brake band about said brake drum.

2. The portable winch of claim 1 including means for adjusting said brake, wherein said brake lever means defines an aperture, said means for adjusting said brake including a threaded member attached fixedly to said brake band and extending from an end thereof and an adjustable nut threadedly attached to said threaded member, said threaded member passing through said aperture.

3. The portable winch of claim 1, including a Y-shaped bridle having a pair of legs and means located on said rear side of said gearcase and said spool supporting frame, respectively, for attaching the legs of said bridle to said winch, and further including a pair of cable spooling guide bars located on said front side of said spool-supporting frame and oriented generally parallel with said spool axis of rotation.

4. A portable winch, comprising:

(a) a gearcase having opposite first and second ends and front and rear sides;

(b) a spool-supporting frame extending from said first end;

(c) a spool carried on said frame and defining a spool axis of rotation extending directly toward said gearcase;

(d) an engine fixedly attached to said second end of said gearcase;

(e) a first winch-supporting handle extending from said second end of said gearcase and located above said engine and forward of and generally parallel with said spool axis of rotation;

(f) a second winch-supporting handle extending generally horizontally rearward from said rear side of said gearcase;

(g) a set of speed reduction gears including a final driven gear located in said gearcase;

(h) a positive engagement clutch for selectively connecting said reduction gears drivingly to said spool, said positive engagement clutch including a final driven shaft, a slidable member disposed axially slidably on said shaft and keyed thereto for rotation therewith, and mating means for coupling said slidable member to said final driven gear so as to prevent said slidable member from rotating with respect to said final driven gear;

(i) lever-operated means for controlling said positive engagement clutch, said lever-operated means including a lever located adjacent said second end of said gearcase;

(j) a throttle control lever mounted on said second end of said gearcase and rotatable about a throttle control lever axis extending substantially parallel with said first handle;

(k) a finger contact bar attached fixedly to said throttle control lever, extending generally parallel with and located below said first handle and spaced apart therefrom, but within reach of a hand holding said first handle, and moveable toward said first handle so as to rotate said throttle control lever about said throttle control lever axis;

(l) means connecting said throttle control lever to said engine for accelerating said engine in response to movement of said finger contact bar toward said first handle;

(m) a brake drum mounted on said final driven shaft;

(n) a brake band encircling said brake drum; and (o) brake lever means pivotably mounted on said first end of said gearcase and extending rearwardly alongside said second handle, within reach of a finger of a hand while said hand holds said second handle, for selectively tightening said brake band about said brake drum.

5. The portable winch of claim 4, further comprising a centrifugal clutch for connecting said engine to said speed reduction gears.

6. The portable winch of claim 5, said centrifugal clutch being adjusted to transmit power from said engine to said reduction gearing when said engine operates above a predetermined minimum speed and to slip so as to limit the amount of torque applied to said speed reduction gears to a predetermined maximum amount.

7. The portable winch of claim 4 wherein said final driven gear is rotatably disposed about said final driven shaft of said positive engagement clutch and said lever-operated means for controlling said positive engagement clutch includes:

(i) an axially slidable clutch operating rod located parallel with said final driven shaft and extending outwardly through a part of said gearcase;

(ii) a shifter fork fixedly mounted on said clutch operating rod within said gearcase, a circumferential groove being defined in said slidable member, and said shifter fork being engaged in said groove;

(iii) biasing means including a helical spring disposed about said clutch operating rod within said gearcase for urging said slidable member toward a position of engagement in which said mating means couples said slidable member to said final driven gear; and (iv) bistable means for holding said lever-operated means selectively in a position retaining said positive engagement clutch in a disengaged position in which said mating means is disengaged, or an engaged position wherein said biasing means holds said slidable member in said position of engagement, said bistable means including a side and an end of said lever, said clutch operating rod being pivotably connected to said lever and said helical spring urging said lever toward an exterior surface of said gearcase, said lever being stable with either said side or said end lying against said exterior surface of said gearcase, and said positive engagement clutch being engaged when one of said end and said side is lying against said exterior surface and disenggged when the other of said end and said side is lying against said exterior surface.

* * * * *

UNITED STATES PATENT AND TRADEMARK OFFICE

CERTIFICATE OF CORRECTION

PATENT NO. : 4,588,167

DATED : May 13, 1986

INVENTOR(S) : Jack E. Finzel

It is certified that error appears in the above-identified patent and that said Letters Patent is hereby corrected as shown below:

| | |
|---|---|
| Col. 1, Line 13 | Change "haVe" to --have-- |
| Col. 2, Line 25 | Change "o" to --on-- |
| Col. 3, Line 5 | After "is" insert --a-- |
| Col. 3, Line 7 & 8 | Change "assemby" to --assembly-- |
| Col. 3, Line 41 | Change "21" to --seven-- |
| Col. 3, Line 48 | Change "there" to --they-- |
| Col. 4, Line 4 | Change "Where" to --where-- |
| Col. 6, Line 32 | Change "on" to -one-- |
| Col. 6, Line 58 | Change "controlably" to --controllably-- |
| Col. 7, Line 55 | Change "spool supporting" to --spool-supporting-- |
| Col. 10, Line 10 | Change "disenggged" to --disengaged-- |

Signed and Sealed this

Thirteenth Day of January, 1987

*Attest:*

DONALD J. QUIGG

*Attesting Officer*

*Commissioner of Patents and Trademarks*